US012721493B2

(12) United States Patent
Samoilov

(10) Patent No.: US 12,721,493 B2
(45) Date of Patent: Sep. 1, 2026

(54) SQUEEZE BUCKET WITH FLAT MOP

(71) Applicant: OOO "BRENDSHAB", Moscow (RU)

(72) Inventor: Vsevolod Alexandrovich Samoilov, Moscow (RU)

(73) Assignee: OOO "BRENDSHAB", Moscow (RU)

( * ) Notice: Subject to any disclaimer, the term of this patent is extended or adjusted under 35 U.S.C. 154(b) by 326 days.

(21) Appl. No.: 18/529,462

(22) Filed: Dec. 5, 2023

(65) Prior Publication Data

US 2024/0206698 A1 Jun. 27, 2024

(51) Int. Cl.

| | |
|---|---|
| ***A47L 13/60*** | (2006.01) |
| ***A47L 13/256*** | (2006.01) |
| ***A47L 13/58*** | (2006.01) |
| ***A47L 13/59*** | (2006.01) |

(52) U.S. Cl.

CPC ..... *A47L 13/60* (2013.01); *A47L 13/256* (2013.01); *A47L 13/58* (2013.01); *A47L 13/59* (2013.01)

(58) Field of Classification Search

CPC ..... A47L 13/60; A47L 13/256; A47L 13/58; A47L 13/59

See application file for complete search history.

(56) References Cited

U.S. PATENT DOCUMENTS 2,796,617 A * 6/1957 Bradshaw ..... A47L 13/60 403/120
6,115,878 A * 9/2000 McLaughlin ..... A47L 13/60 15/262
9,609,994 B2 * 4/2017 Young ..... A47L 13/59
10,070,768 B2 * 9/2018 Young ..... B08B 1/12
2020/0345200 A1 * 11/2020 Huang ..... A47L 13/256

FOREIGN PATENT DOCUMENTS

GB 2480294 A * 11/2011 ..... A47L 13/60
WO WO-2017206511 A1 * 12/2017 ..... A47L 13/59

* cited by examiner

*Primary Examiner* — Eldon T Brockman
(74) *Attorney, Agent, or Firm* — Muncy, Geissler, Olds & Lowe, P.C.

(57) ABSTRACT

This disclosure is directed to a squeeze bucket with a bucket body and a handle, a flat mop, and a water squeezing section. The water squeezing section has an opening for accommodating a flat mop working part and a squeezing element. The flat mop provides a mop rod, the flat mop working part rotatably mounted on the mop rod, and a cleaning cloth mounted on the flat mop working part. The bucket body is divided into a main chamber and a squeezing chamber by a vertical wall mounted between side walls of the bucket body, and the water squeezing section is mounted above the squeezing chamber of the bucket body. A rinsing section is provided with an opening for accommodating the flat mop working part and a cleaner that is mounted above the main chamber of the bucket body, the water squeezing section and the rinsing section are rigidly connected to each other, located in the same horizontal plane, and mounted in the upper part of the bucket body. A bracket is mounted under the water squeezing section, the squeezing element is rotatably mounted in the bracket, and the squeezing element and the cleaner are located parallel to the flat side of the working part of the flat mop, and the lower part of the bucket body from the main chamber and squeezing chamber comprises water drain holes equipped with a plug.

6 Claims, 6 Drawing Sheets

SQUEEZE BUCKET WITH FLAT MOP

BACKGROUND OF THE INVENTION

The invention relates to a set of devices for wet mopping floors, in particular to a mop bucket, cleaning and squeezing device for a flat mop.

A CLEANING SET is known which comprises a squeeze mop and a bucket with two chambers and is a mop and bucket set that allows for effortless one-handed washing and squeezing. The squeeze mop swivels 180 degrees and easily rounds corners, furniture legs and various obstacles. The microfiber mop head efficiently picks up dirt, hair and pet fur. It retains water up to 70% better than cotton.

The main technical problem of the set is:

insufficient squeezing of the mop cleaning cloth;

poor hair cleaning when rinsing and squeezing the mop cleaning cloth.

MOBBY SQUEEZE MOP AND RINSING BUCKET set is known, which is a mopping and house cleaning set comprising a bucket with two chambers and a vertical squeezer and a mop with a composite handle. One of the chambers is used to wet the mop head, while the second chamber equipped with a spring-loaded squeegee removes moisture to the required level to perform wet mopping without an abundance of water on the floor. The squeeze mop consists of several sections, with a soft rubberized handle. The soft, replaceable microfiber mop head provides moisture absorption and dirt removal.

The main technical problem of the set is:

insufficient squeezing of the mop cleaning cloth;

poor hair cleaning when rinsing and squeezing the mop cleaning cloth.

The closest analogue is a BUCKET FOR MOP, DESIGNED FOR CLEANING AND SQUEEZING FLAT MOP [RU 2690101, published: 30 May 2019], which is a cleaning device set comprising a bucket body and a flat mop; wherein the bucket body comprises a handle and the flat mop comprises a mop rod, a working part of the mop rotatably mounted on the mop rod, and a cleaning cloth mounted on the working part on the mop; wherein the bucket body has a water squeezing section, the squeezer is positioned above the water squeezing section; wherein, when the working part of the flat mop is rotated to the squeezing position and inserted with the possibility to be removed into the squeezing device, the cleaning cloth is positioned within the water squeezing section, the squeezing device is pressed against the cleaning cloth on the working part of the mop and provides friction with the cleaning cloth on the working part of the mop to squeeze water from the cleaning cloth; wherein a water flow element for transferring water squeezed from the cleaning cloth from the water squeezing section is located in the water squeezing section. The squeezing device comprises a frame and a squeezing element; the frame has a squeezing opening for accommodating the working part of the mop in the water squeezing position, the squeezing element being arranged adjacent the squeezing opening so that the squeezing element can be pressed against the cleaning cloth on the working part of the mop to provide friction with the cleaning cloth.

The main technical problem of the disclosed set is:

insufficient squeezing of the mop cleaning cloth;

poor hair cleaning when rinsing and squeezing the mop cleaning cloth.

SUMMARY OF THE INVENTION

The technical result of the invention is to improve the quality of the mop cleaning cloth squeezing and cleaning from hair during rinsing and squeezing.

The specified technical result is achieved due to the fact that a squeeze bucket with flat mop comprises a bucket body with a handle, a flat mop, a water squeezing section consisting of an opening to accommodate flat mop working part and squeezing element, the flat mop comprises a mop rod, a working part of the mop, which working part is rotatably mounted on the mop rod, and a cleaning cloth located on the working part of the flat mop, wherein the inner volume of the bucket body is divided into main chamber and squeezing chamber by a vertical wall mounted between the side walls of the bucket body, a water squeezing section is mounted above the squeezing chamber of the bucket body, a rinsing section is mounted above the main chamber of the bucket body and comprises an opening for holding the working part of the mop and a cleaner, the water squeezing section and the rinsing section are rigidly connected to each other, located in the same horizontal plane, and mounted in the upper part of the bucket body, a bracket is mounted under the water squeezing section, a squeezing element is rotatably mounted in the bracket, and the squeezing element and the cleaner are located parallel to the flat side of the working part of the flat mop, and the lower part of the bucket body from the main and squeezing chambers comprises holes for water drainage equipped with plugs.

In particular, the squeezing element comprises an axis and a drum, ribs and grooves are alternately mounted along the periphery of the drum in parallel rows relative to the axis, the ribs have one side rigidly fixed to the outer surface of the drum, and the other side is directed in different directions from the axis, pile threads are mounted in the grooves of the drum perpendicular to the axis and pointed toward the accommodated working part of the flat mop, and the length of the pile threads exceeds the height of the ribs.

In particular, resilient elements are provided between the bracket and water squeezing section.

In particular, the cleaner has grooves made in parallel longitudinal rows, with pile threads mounted in the grooves being pointed toward the accommodated working part of the flat mop.

In particular, the pile threads in the grooves of the cleaner are mounted crosswise.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

Figure 1:
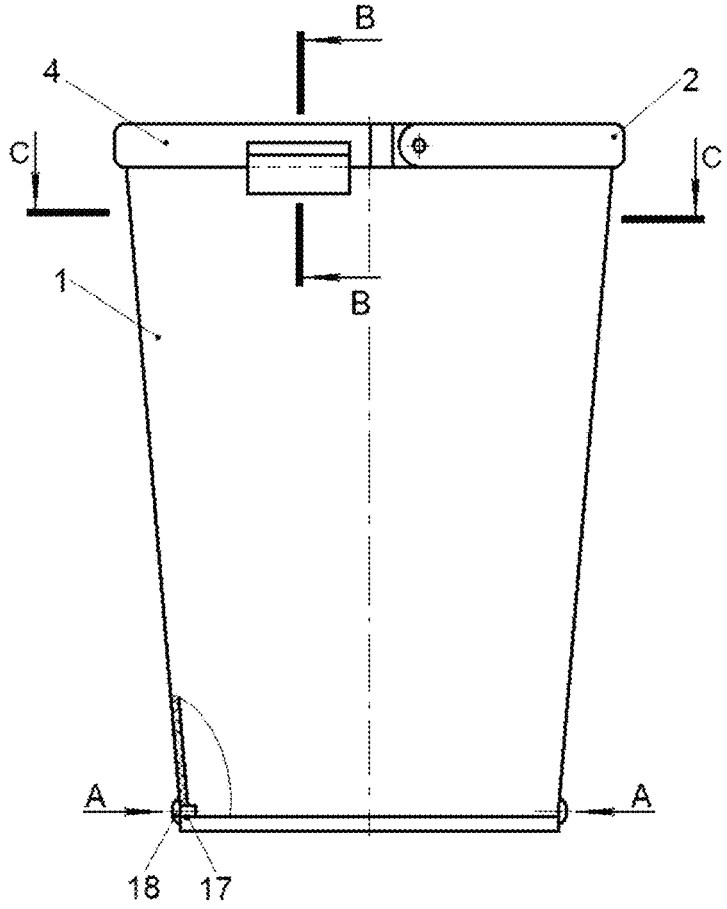
FIG. 1 shows a bucket body with a handle and water squeezing and rinsing sections, side view.
Figure 2:
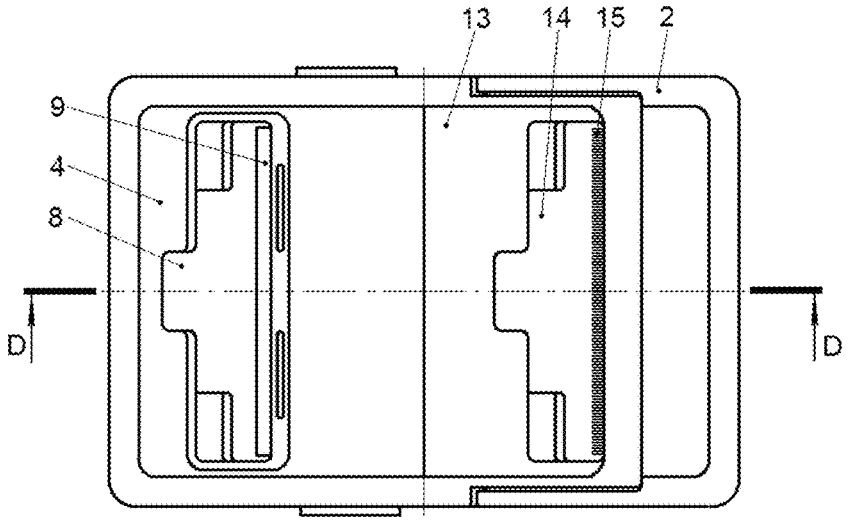
FIG. 2 shows the bucket body with the handle and water squeezing and rinsing sections, top view.
Figure 3:
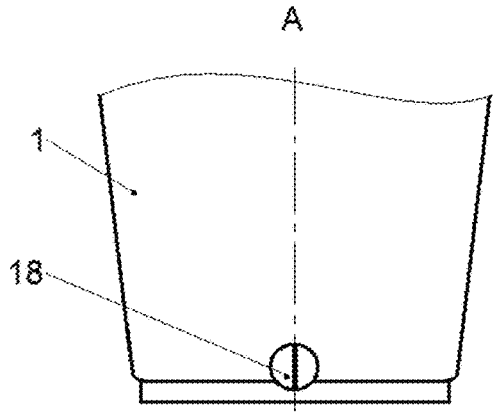
FIG. 3 shows the lower part of the bucket body with water drain holes, view A.
Figure 4:
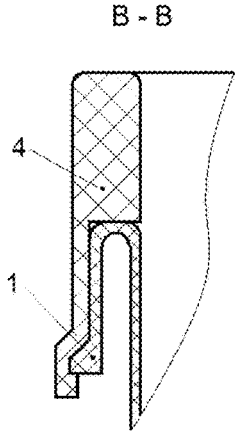
FIG. 4 shows the connection of the sections to the upper part of the bucket body, a section along the line B-B.
Figure 5:
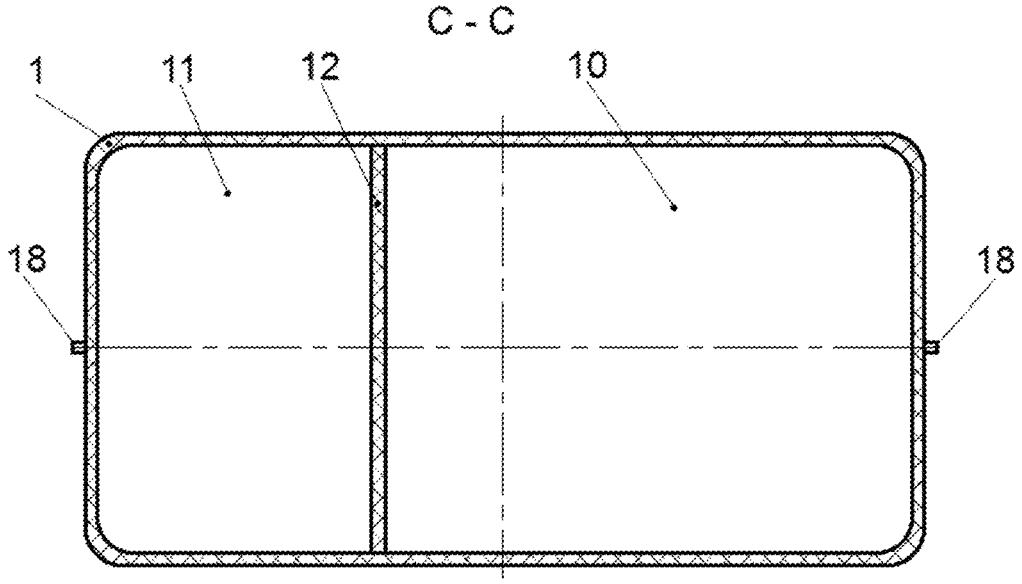
FIG. 5 shows a section of the bucket body along the line C-C.
Figure 6:
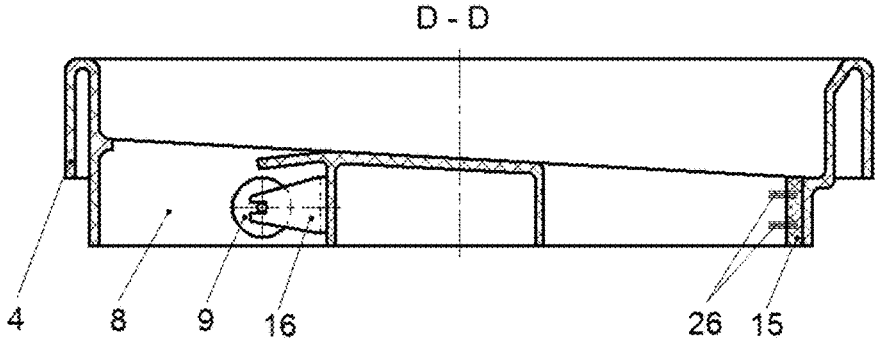
FIG. 6 shows a sectional view of the water squeezing and rinsing sections along the line D-D.
Figure 7:
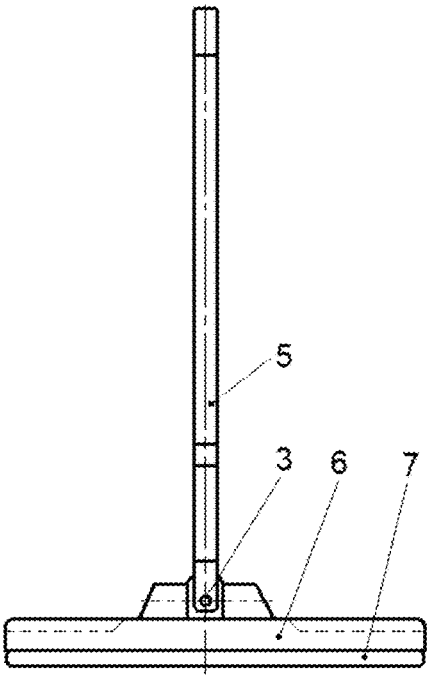
FIG. 7 shows a flat mop, front view.
Figure 8:
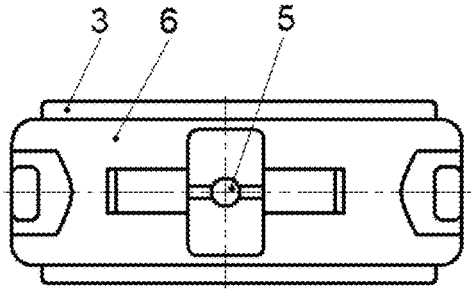
FIG. 8 shows a flat mop, top view.

The figures indicate: 1 is bucket body, 2 is handle, 3 is flat mop, 4 is water squeezing section, 5 is rod, 6 is working part, 7 is cleaning cloth, 8 and 14 are holes, 9 is squeezing element, 10 is main chamber, 11 is squeezing chamber, 12 is vertical wall, 13 is rinsing section, 15 is cleaner, 16 is bracket, 17 are water drain holes, 18 are plugs, 19 is axis, 20 is drum, 21 are ribs, 22 and 25 are grooves, 23 and 26 are pile threads, and 24 are resilient elements.

DETAILED DESCRIPTION OF THE INVENTION

A squeeze bucket with flat mop comprises a bucket body 1 with a handle 2, a flat mop 3, and a water squeezing section 4.

The flat mop 3 comprises a rod 5, a working part 6 rotatably mounted on the rod 5, and a cleaning cloth 7 mounted on the working part 6 of the flat mop 3.

The water squeezing section 4 consists of an opening 8 for accommodating the working part 6 of the flat mop 3 and a squeezing element 9.

The inner volume of the bucket body 1 is divided into main chamber 10 and squeezing chamber 11 by a vertical wall 12 mounted between the side walls of the bucket body 1.

The water squeezing section 4 is mounted above the squeezing chamber 11 of the bucket body 1. Above the main chamber 10 of the bucket body 1, the rinsing section 13 is mounted, which rinsing section comprises an opening 14 for accommodating the working part 6 of the flat mop 3 and a cleaner 15.

The water squeezing section 4 and the rinsing section 13 are rigidly connected to each other, located in the same horizontal plane, and mounted in the upper part of the bucket body 1.

A bracket 16 is mounted under the water squeezing section 4. The squeezing element 9 is rotatably mounted in the bracket 16, wherein the squeezing element 9 and the cleaner 15 are arranged parallel to the flat side of the working part 6 of the flat mop 3.

In the lower part of the bucket body 1 from the main chamber 10 and the squeezing chamber 11, water drain holes 17 are arranged and provided with plugs 18.

Figure 9:
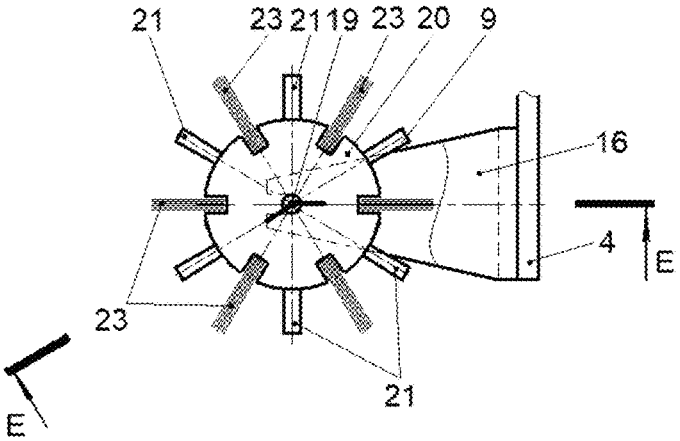
FIG. 9 shows a squeezing element, side view.
Figure 10:
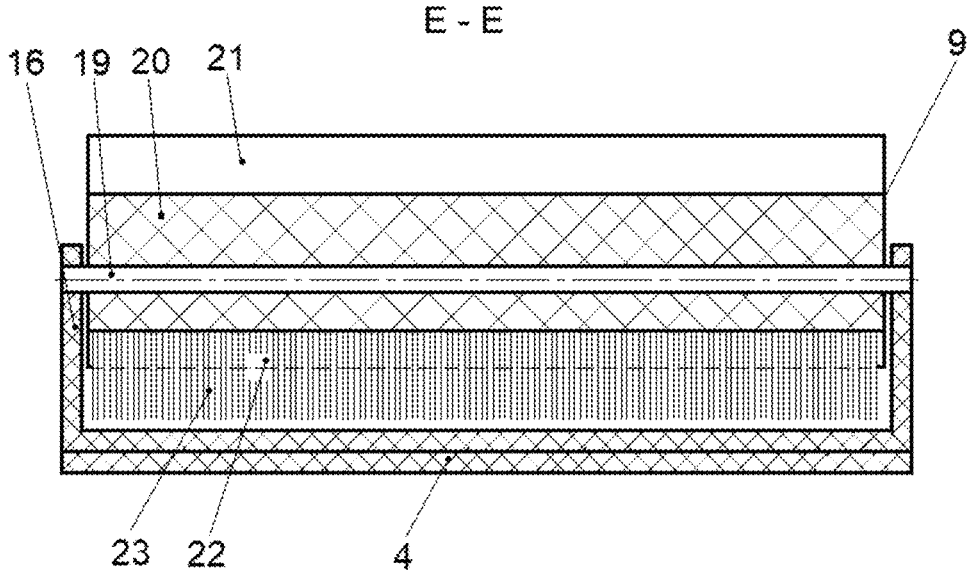
FIG. 10 shows the squeezing element, a section along the line E-E.

In particular, in one embodiment of the device, the squeezing element 9 comprises an axis 19 and a drum 20 (see FIG. 9, FIG. 10). Along the periphery of the drum 20, ribs 21 are alternately mounted in parallel rows relative to the axis 19 and grooves 22 are made. The ribs 21 have one side rigidly fixed to the outer surface of the drum 20, and the other side is directed in different directions from the axis 19. Pile threads 23 are mounted in the grooves 22 of the drum 20 perpendicular to the axis 19 and pointed toward the accommodated working part 6 of the flat mop 3, wherein length of the pile threads 23 exceeds the height of the ribs 21.

Figure 11:
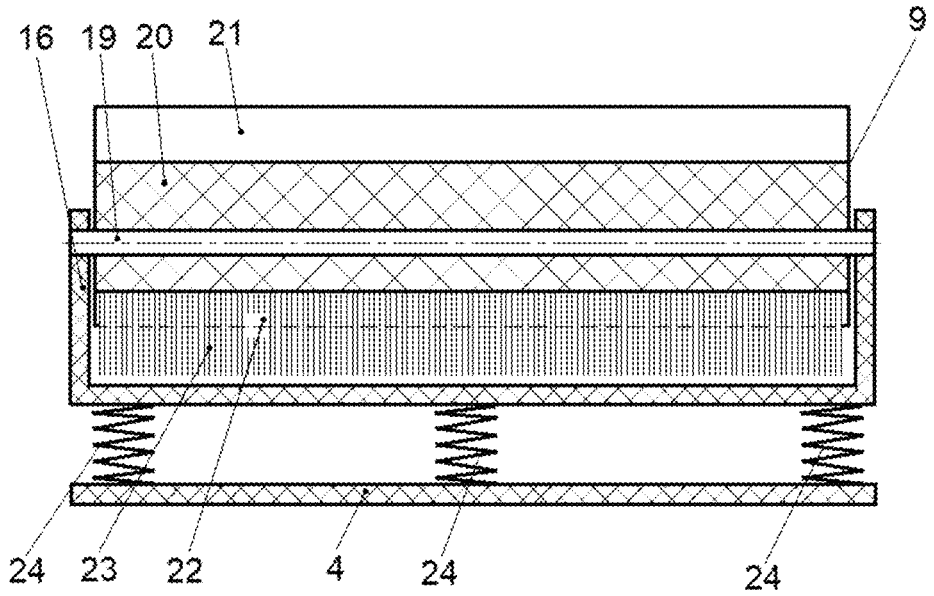
FIG. 11 shows the squeezing element with resilient elements.

In particular, resilient elements 24 may be provided between the bracket 16 and the water squeezing section 4 (see FIG. 11).

Figure 12:
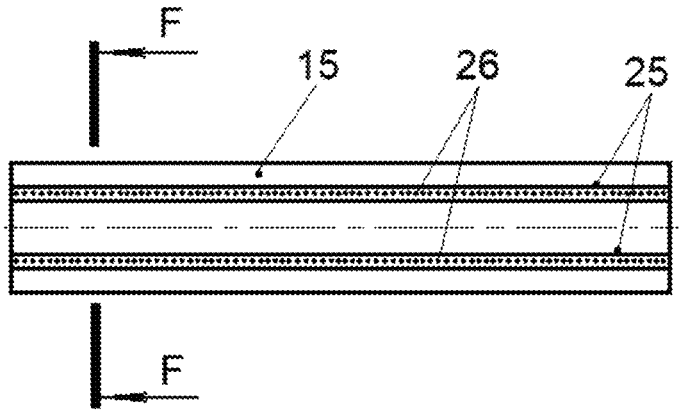
FIG. 12 shows a cleaner, front view.
Figure 13:
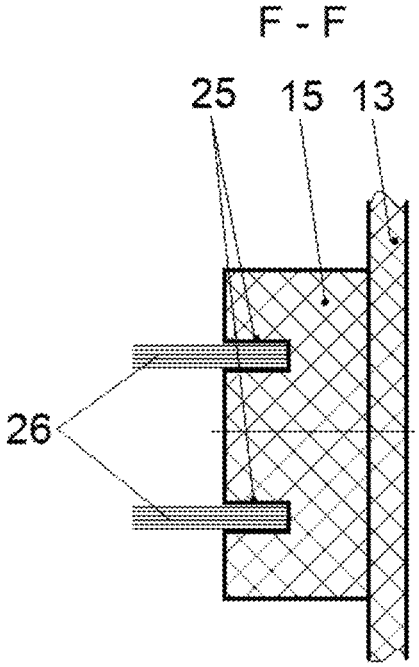
FIG. 13 shows a cross section of the wiper along the line F-F.

The cleaner 15 has grooves 25 made in parallel longitudinal rows, and pile threads 26 are mounted in the grooves 25 and pointed toward the accommodated working part 6 of the flat mop 3 (see FIG. 12, FIG. 13).

Figure 14:
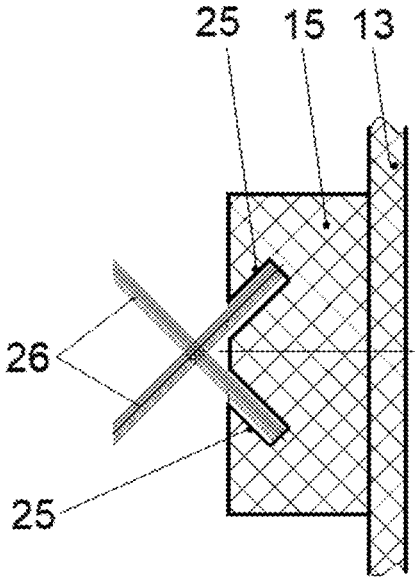
FIG. 14 shows pile threads mounted crosswise in grooves of a cleaner.

In particular, in one embodiment of the device, the pile threads 26 in the grooves 25 of the cleaner 15 are mounted crosswise (see FIG. 14).

The squeeze bucket with flat mop is used as follows.

Preliminarily, the interconnected water squeezing section 4 and the rinsing section 13 are mounted in the upper part of the bucket body 1 such that the water squeezing section 4 is positioned above the squeezing chamber 11, and the rinsing section 13 is positioned above the main chamber 10.

Water is poured into the main chamber 10 of the bucket body 1 up to a level corresponding to the height of the working part 6 of the flat mop 3. In this case, the plugs 18 are located inside the water drain holes 17.

Then, the working part 6 of the flat mop 3 with the cleaning cloth 7 mounted therein is rinsed. For this, the handle 2 of the flat mop 3 is deflected toward the working part 6 at an angle of 90 degrees. Due to the hinge connection, the handle 2 will be parallel to the working part 6 of the flat mop 3 (see FIG. 15).

The flat mop 3 is placed over the rinsing section 13 of the bucket body 1 (see FIG. 15), and the cleaning cloth 7 is rinsed by vertical movement of the flat mop 3 through the opening 14 toward the bottom of the bucket body 1. At the same time, the pile threads 26 of the cleaner 15 slide along the flat surface of the cleaning cloth 7.

Figure 16:
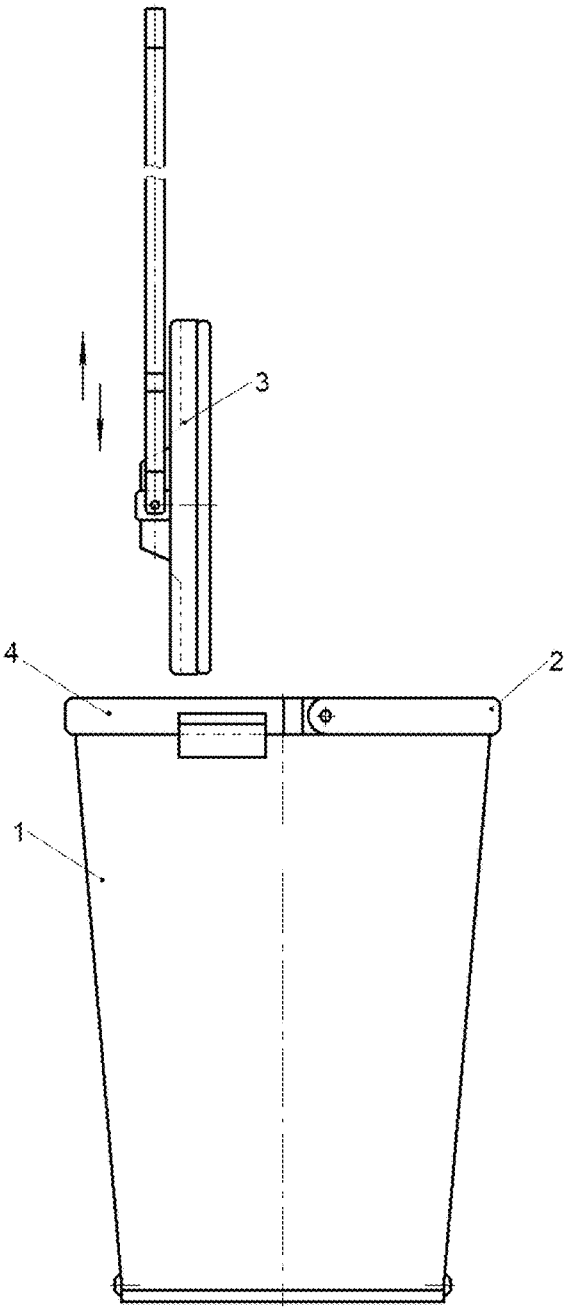
FIG. 16 shows the squeezing process of the flat mop.

Then, the flat mop 3 is placed over the water squeezing section 4 of the bucket body 1 (see FIG. 16), and "excessive" moisture is squeezed from the cleaning cloth 7 by vertical movement of the flat mop 3 through the opening 8 toward the bottom of the bucket body 1. During the vertical movement of the flat mop 3 through the opening 8, the drum 20 of the squeezing element 9 rotates around the axis 19, tightly fitting the cleaning cloth 7 and compressing it by the ribs 21, and squeezes "excessive" moisture from the cleaning cloth 7.

Further, the working part 6 of the flat mop 3 is moved to a desired position relative to the handle 5 and the floor surface, walls and the like are washed.

Figure 15:
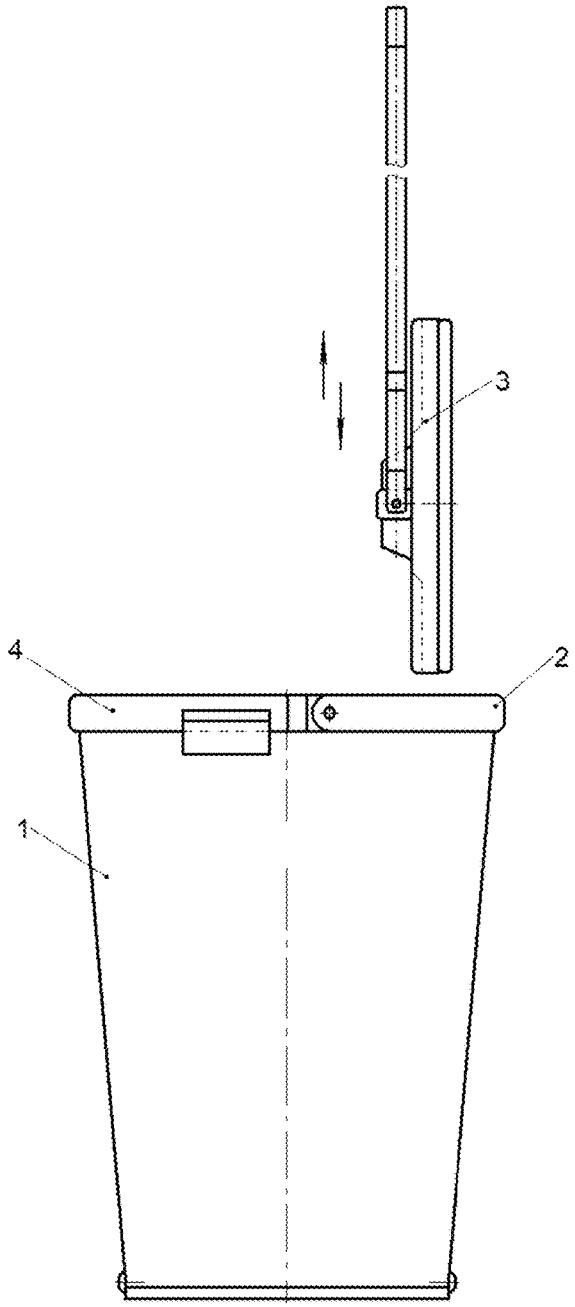
FIG. 15 shows the rinsing process of the flat mop.

When the cleaning cloth 7 is soiled in the process of washing the surface, the handle 2 of the flat mop 3 is deflected toward the working part 6 at an angle of 90 degrees until it is parallel to the working part 6 of the flat mop 3 (see FIG. 15). Then, the flat mop 3 is placed over the rinsing section 13 of the bucket body 1, and the cleaning cloth 7 is rinsed with simultaneous cleaning of the cleaning cloth by vertical movement of the flat mop 3 through the opening 14 downward and upward relative to the bucket body 1. At the same time, the pile threads 26 of the cleaner 15 slide along the flat surface of the cleaning cloth 7 and clean off hair and cobweb.

Further, the flat mop 3 is placed over the water squeezing section 4 of the bucket body 1 (see FIG. 16) and by vertical movement of the flat mop 3 through the opening 8 upward and downward relative to the bucket body 1 not only squeezes "excessive" moisture from the cleaning cloth 7, but also additionally cleans the cleaning cloth 7 from remaining hair and cobweb.

During vertical movement of the flat mop 3 through the opening 8, the drum 20 of the squeezing element 9 rotates around the axis 19, fitting tightly to the cleaning cloth 7 and compressing it with the ribs 21, and squeezes "excessive" moisture from the cleaning cloth 7. At the same time, the pile threads 23 located between the ribs 21 additionally clean the cleaning cloth 7 from remaining hair and cobweb.

After visual determination of the quality of cleaning and squeezing the cleaning cloth 7, the surface washing process is repeated.

After completion of the surface washing process, the contaminated water from the main chamber 10 and the squeezing chamber 11 is drained. To do this, the plugs 18 are removed from the water drain holes 17.

The division of the internal volume of the bucket body 1 into the main chamber 10 and the squeezing chamber 11 by the vertical wall 12 mounted between the side walls of the bucket body 1, and, accordingly, arrangement of the water squeezing section 4 above the squeezing chamber 11 of the bucket body 1 and the rinsing section 13 above the main chamber 10 of the bucket body 1 makes it possible to exclude contamination of the cleaning cloth 7 with "dirty" water when squeezing the cleaning cloth after the rinsing.

The presence of the openings 8, 14 allows for accommodating the working part 6 of the flat mop 3 in the water squeezing section 4 and in the rinsing section 13 when rinsing and squeezing the cleaning cloth 7.

The rigid connection of the water squeezing section 4 and the rinsing section 13 to each other and their location in the same horizontal plane in the upper part of the bucket body 1 allows to provide the same distance between the bottom of the bucket body 1 and the cleaner 15 and between the bottom of the bucket body 1 and the squeezing element 9, that, taking into account the constant length of the working part 6 of the flat mop 3, will provide the maximum equal penetration of the working part 6 of the flat mop 3 with the cleaning cloth 7 into the main chamber 10 and squeezing chamber 11 of the bucket body 1 and, accordingly, the maximum contact interaction of the squeezing element 9 and cleaner 15 with the cleaning cloth 7.

The presence of the cleaner 15 having the grooves 25 made in the parallel longitudinal continuous rows, with the pile threads 26 mounted in the grooves and pointed toward the accommodated working part 6 of the flat mop 3, including crosswise mounting the pile threads 26 in the grooves 25 of the cleaner 15, and the location of the cleaner 15 parallel to the flat side of the working part 6 of the flat mop 3 allows for the most efficient cleaning of hair and cobweb from the flat surface of the cleaning cloth 7 without leaving untreated strips.

The presence of the squeezing element 9 rotatably mounted in the bracket 16, with the squeezing element 9 being arranged parallel to the flat side of the working part 6 of the flat mop 3, makes it possible to ensure constant contact of the squeezing element 9 with the cleaning cloth 7 and, accordingly, efficient squeezing "excessive" water from the cleaning cloth.

The alternate mounting of the ribs 21 and pile threads 23 in parallel rows relative to the axis 19 along the periphery of the drum 20, with the pile threads 23 pointed toward the accommodated working part 6 of the flat mop 3 and length of the pile threads 23 exceeding the height of the ribs 21, makes it possible not only to squeeze "excessive" water from the cleaning cloth, but also to clean the cleaning cloth 7 from remaining hair and cobweb.

The arrangement of the resilient elements 24 between the bracket 16 and the water squeezing section 4 ensures that the squeezing element 9 is always pressed against the cleaning cloth 7, regardless of the thickness of the cleaning cloth 7.

The presence of the water drain holes 17 provided with plugs 18 in the main chamber 10 and squeezing chamber 11 in the lower part of the bucket body 1 allows for draining "dirty" water from the main chamber 10 and squeezing chamber 11 of the bucket body 1 without directly overturning the bucket into a container or sewer.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

I claim:

1. A squeeze bucket comprising:

a bucket body with a handle;

a flat mop;

a water squeezing section, the water squeezing section consisting comprises of an opening for accommodating a flat mop working part and a squeezing element, wherein the flat mop comprises a mop rod, the flat mop working part rotatably mounted on the mop rod, and a cleaning cloth mounted on the flat mop working part, and wherein an inner volume of the bucket body is divided into a main chamber and a squeezing chamber by a vertical wall mounted between side walls of the bucket body, the water squeezing section is mounted above the squeezing chamber of the bucket body;

a rinsing section comprising an opening for accommodating the flat mop working part and a cleaner that is mounted above the main chamber of the bucket body, the water squeezing section and the rinsing section are rigidly connected to each other, located in the same horizontal plane, and mounted in the upper part of the bucket body;

a bracket is mounted under the water squeezing section, the squeezing element is rotatably mounted in the bracket, and the squeezing element and the cleaner are located parallel to the flat side of the working part of the flat mop, and the lower part of the bucket body from the main chamber and squeezing chamber comprises water drain holes equipped with plugs.

2. The squeeze bucket according to claim 1, wherein the squeezing element comprises an axis and a drum, ribs and grooves, wherein the ribs and the groves are alternately mounted along the periphery of the drum in parallel rows relative to the axis, the ribs have one side rigidly fixed to an outer surface of the drum, and a second side of the ribs is directed in a different direction from the axis, pile threads are mounted in the grooves of the drum perpendicular to the axis and pointed toward the accommodated flat mop working part, and wherein a length of the pile threads exceeds a height of the ribs.

3. The squeeze bucket according to claim 1, wherein resilient elements are mounted between the bracket and the water squeezing section.

4. The squeeze bucket according to claim 1, wherein the grooves are made on the cleaner in parallel longitudinal rows, and the pile threads are mounted in the grooves and pointed toward the flat mop working part.

5. The squeeze bucket according to claim 1, wherein the pile threads in the grooves of the cleaner are mounted crosswise.

6. A bucket comprising:

a bucket body divided into a main chamber and a squeezing chamber by a vertical wall mounted between side walls of the bucket body;

a flat mop with a mop rod and a flat mop working part rotatably mounted on the mop rod;

a water squeezing section mounted between the side walls of the bucket body, the water squeezing section comprises:

an opening for accommodating the flat mop working part; and a squeezing element, wherein the squeezing element comprises:

an axis and a drum, ribs and grooves, wherein the ribs and the groves are alternately mounted along the periphery of the drum in parallel rows relative to the axis, the ribs have one side rigidly fixed to an outer surface of the drum, and a second side of the ribs is directed in a different direction from the axis, pile threads are mounted in the grooves of the drum perpendicular to the axis and pointed toward the flat mop working part.

* * * * *